United States Patent [19]

Owen

[11] 4,015,069

[45] Mar. 29, 1977

[54] APPARATUS FOR EXTRACTING METALS FROM ORE

[76] Inventor: Robert G. Owen, 1980 Lake St., Huntington Beach, Calif. 92646

[22] Filed: Sept. 11, 1975

[21] Appl. No.: 612,268

Related U.S. Application Data

[62] Division of Ser. No. 498,209, Aug. 16, 1974.

[52] U.S. Cl. ..... 13/9 R; 75/10 R; 219/69 M

[51] Int. Cl.[2] ..... H05B 7/00

[58] Field of Search ..... 13/1, 9, 18; 219/69 R, 219/69 M, 68; 75/10, 63

[56] References Cited

UNITED STATES PATENTS

| | | | |
|---|---|---|---|
| 1,506,320 | 8/1924 | Northrup | 13/9 |
| 2,278,321 | 3/1942 | Keir | 13/9 X |
| 3,115,569 | 12/1963 | Darling | 219/69 M |

*Primary Examiner*—R. N. Envall, Jr.

[57] ABSTRACT

An apparatus for extracting metals from ore by electrical discharge therethrough which melts the available metallic values into separated nuggets. Pulverized ore, preferably ionized, is supported upon one electrode and subjected to random discharge of electrical current from at least one opposing electrode. In one form, the ore contacts the opposing electrodes so that the ever changing paths of least resistance conduct the current therebetween to create the smelting heat. In another form, a multiplicity of closely spaced electrode points are spaced from the ore so that ever changing paths of least resistance "spikes" arc therebetween to create the smelting heat. This method is preferably protectively conducted between closely related electrodes contacting the ore therebetween, and/or in an inert environment or immersed in a fluid. The electrical energy is intermittely applied at frequencies best suited to react efficiently on the ore involved, and the processing of ore and resultant production of solid fused metals is preferably continuous with the use of conveyor means delivering the same from the electrodes.

20 Claims, 10 Drawing Figures

APPARATUS FOR EXTRACTING METALS FROM ORE

This is a division of application Ser. No. 498,209 filed Aug. 16, 1974 entitled METHOD FOR EXTRACTING METALS FROM ORE.

BACKGROUND

This invention relates to the extraction of metals from ore and particularly exotic and/or precious metals such as gold, silver, platinum, palladium, iridium, and others, which are most often available in a mixture of alloy thereof. The metallic values which are sought for are found in a postmetallic crystaline state, a metallic state, and a postmetalic isotopic state; and the complexity of ores varies greatly in this respect. Although there are various methods of extracting ores, it is often difficult and sometimes impossible to extract the desired metals on an economically practical basis, and in some instances not at all. In practice, the usual methods of smelting and leaching ores for their metal values does not produce 100% recovery, and the tailings retain measureably high values of metals. Therefore, it is an object of this invention to provide an improved method and apparatus for the substantially complete (90–100%) extraction of metals from ore.

The reduction of metals from ore follows many processes, some of which are very efficient. However, there are vast quantities of tailings available from smelters and the like that are rich in precious metals; also, there are vast quantities of virgin ores that are rich in precious metals; and yet in many instances there has been no practical method for substantially complete extraction thereof. And further, there are tailings and virgin ores that cannot be assayed to show any metallic values, but which show color bands indicating metals when exposed on a spectograph. It is these marginal tailings and ores with which the present invention is particularly concerned, it being a general object of this invention to extract metallic values from tailings and ores which have heretofore assayed as economically valueless.

Smelting of ores is usually conducted in a furnace wherein high heat is directly or indirectly applied. There are of course advantages to be gained by the various indirect and direct heat methods, which need not be discussed here, and the application of electrical energy applied directly as an arc from or between electrodes is well known. However, the violence of energy application is an electric arc furnace, for example, is destructive of the metals by vaporization, and to this end the discharge of electrical energy for these purposes has been conducted in a slurry of the ore to be reduced. For example, ores are reduced to their metallic values by intermittently striking a high frequency electrical arc through a slurry of the ore and along a path between electrodes. And though it is possible to extract solid state metals in this way, the percentage of reduction is limited because of the localized application of the electrical arc. In other words, the total mass of the ore is not completely subjected by the prior art processes. However, with the present invention a substantially complete subjection is attained, it being an object of this invention to provide a method and apparatus for the substantially complete subjection of ores to the smelting effect of electrical energy discharged therethrough. With the present invention, electrical discharges are distributed over a determinable area and through a layer of ore coextensive with said area, and to the end that substantially complete subjection is attained.

The discharge of high intensity electrical arcs through a slurry of ore has been practiced for the reduction of metals in a cooling environment. It has been theorized that the "slurry" of a thin mixture of water and of the many fine insoluble materials comprising the ore, condenses by vaporization and cools the reduced metals to a solid state. It has also been theorized that the slurry of ore subjects the postmetallic as well as postmetalic state of the metal values to the electrical arc for a change of electrons which produces solid state metals. And, the application of electrical energy has been made at or near the natural frequency of the metal to be reduced, so that the metal theoretically assumes a stable state. With the present invention, a "slurry" as such is not employed in the strict sense of a mixture of water and fine insoluble ore. In contradistinction, a layer of ore is deposed upon the surface of an electrode and contracted by or exposed to an electrode of opposite polarity. This contact or exposure can be conducted openly or through a protective fluid in which it is immersed. Thus, a preadmixture of water and ore is not requisite of the present invention. A cover of protective gas or liquid is provided over the layer of ore through which electrical energy is coextensively applied. Therefore, it is an object of the present invention to maintain a layer of ore for reduction separate from an enveloping cover of protective fluid such as water.

The discharge of electrical energy in arc furnaces and the like has been localized and confined to the alignment of the electrodes that strike an arc from point to point. Generally, electrodes for this purpose have been elongated elements projected into aligned spaced opposition as anode and cathode. With the present invention, the anode and cathode are flat faced and opposed positive and negative plates, brought into contact with the pulverized granules of ore, or spaced with the layer of ore therebetween in which case at least one of which is serrated so as to present a multiplicity of discharge peaks disposed uniformly from the other electrode; it being an object to provide energy discharges at random coextensively between said two electrodes. In practice, the lowermost electrode is a flat supporting surface for the ore, while the uppermost electrode has a flat surface that rides upon the ore, or is spaced therefrom and is serrated for random electrical arc discharge.

The transport of ore by the method and through the apparatus is such as to pass all ore between the two aforementioned electrodes for substantially complete subjection randomly between said electrodes. Accordingly, the lowermost electrode is the conveyor which receives the pulverized ore and passes the same in a layer beneath the other electrode superimposed thereover to provide passage therebetween. Therefore, it is an object to provide means to convey ore for its coextensive subjection to electrical energy flowing between spaced electrodes. It is another object to provide for the conveyance of ore upon an electrode while immersed and/or submerged in a protective fluid. It is still another object to provide for the discharge of processed ore while maintaining the protective fluid over the same.

The susceptibility of ores to the effect of electrical discharges can be improved, as has been discovered in practicing the present invention; and accordingly the ore is ionized by removing one ion precedent to introduction between the active electrodes. Further, the use of electronic control circuits enables the conduction of electrical impulses through the ore particles with a balancing of the voltage and amperage factors and by control of the frequencies to coincide with the resonant frequencies best suited to react on the various metalic values. Accordingly, it is still another object of this invention to provide electronic means to ionize and also to control the voltage, amperage and frequencies of the electrical discharges at random from the superimposed electrode.

SUMMARY OF THE INVENTION

The apparatus herein disclosed can be employed in reducing metal values from ore heretofore considered economically valueless. Known principles of electrical discharge are utilized to fuse the metallic values in whatever available state they are found in the ore. The ore from which extraction is to be made is prepared by grinding or milling, and by ionizing before subjection to electrical discharges. The prepared ore is transported in a layer upon the surface of an electrode and passed beneath an electrode of opposite polarity from which controlled frequency impulses are discharged through the layer of ore. A feature of this invention is the random discharge of electrical energy coextensively between said electrodes, whereby the entire area of ore is subjected to the fusing function of the electrical energy acting upon the metallic values therein. The said metallic values are electrically conductive and inherently afford resistance so as to generate heat. The fusing of metallic values is conducted in a protective environment, as a conductive element contacting the two electrodes and/or immersed in a protective atmosphere or submerged in a water bath through which the ore is transported; and the ore being initially ionized, the supporting electrode is preferably the anode (+) and the superimposed electrode the cathode (−). However, the application of alternating potentials has been practiced, in which case the ore particles need not be ionized. The prepared ore is pulverized as required and charged into the water bath to be immersed and supported upon the anode for transport beneath the cathode. The uppermost electrode presents a face from which electrical energy is discharged through the layer of ore, and in one form contacts the ore for conducting current; and in another form spaced from the ore and characterized by its serrated or uniformly peaked surface that provides a multiplicity of discharge points. In either form the electrical energy emanates at random in seeking courses or paths of least resistance through the ore. The ore is distributed in an even layer over the supporting electrode, the electrical energy discharges occurring sequentially at random over the entire area covered by the superimposed electrode, and the dynamics of the ore providing ever changing conditions for the ultimate striking of energy paths throughout the entire area covered by the superimposed electrode. The ore is subjected to the said random discharges of the electrical energy supplied at resonant frequencies best suited to react upon the metallic values to be extracted; and the result is the conduction of electrical energy through the ore and metallic values therein which fuses and melts the latter into a placid or liquid state followed by quenching into a solid nugget or generally of ball-shape. The method and operation of the apparatus is continuous.

DRAWINGS

The various objects and features of this invention will be fully understood from the following detailed description of the typical preferred forms and applications thereof, throughout which description reference is made to the accompanying drawings, in which.

PREFERRED EMBODIMENT

Figure 1:
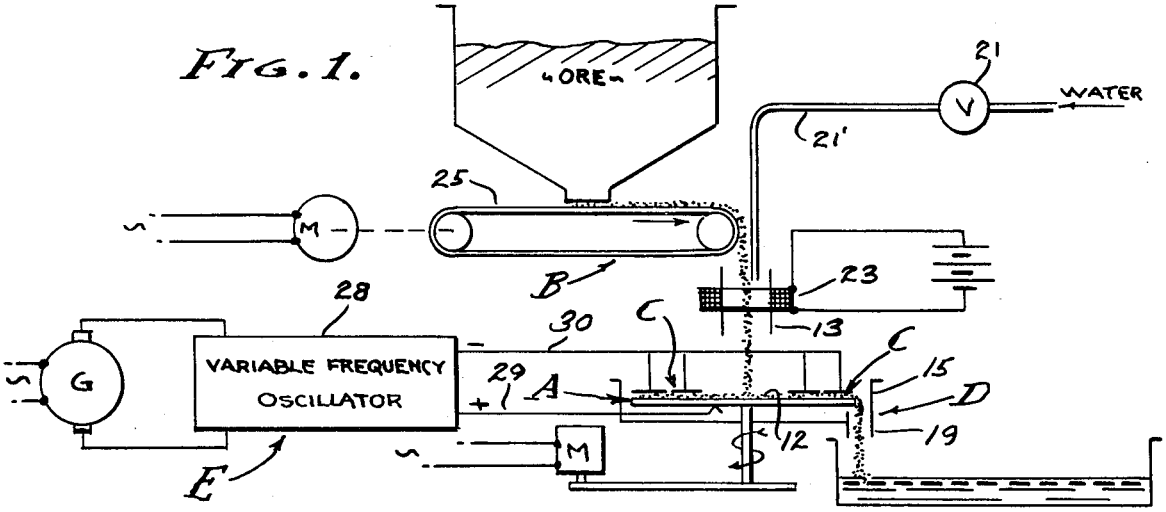
FIG. 1 is a schematic view of the process and first embodiment of the apparatus for extracting metals from ore.

Referring now to the drawings, this method of extracting metals from ore can be embodied in various forms of apparatus as is depicted in the drawings. As summarized above, the metallic values of the ore are smelted by the discharge of electrical energy through a layer of ore deposed upon a conveyor and preferably immersed in a protective bath. A feature of the method is the random discharge of electrical energy which subjects all of the ore to the fusion of the metallic values thereof, and to the end that efficient reduction of the metallic values is attained. Generally, the method steps are as follows: (1) preparation of the ore to granular form; (2) subjecting the prepared ore to a protective environment while; (3) deposing the prepared ore upon a supporting electrode; (4) discharging electrical energy from a multiplicity of electrode points and through the deposed ore to the supporting electrode so as to melt the metallic values from the ore; (5) preferably advancing the prepared ore on the supporting electrode to pass beneath the said multiplicity of electrode points for continuous processing; and (6) discharging the subjected ore for subsequent separation of the solidified and stable metal values therefrom.

1. This method is initiated by preparation of the ore to granular form by pulverizing the same for its deposition in a uniform layer upon a planar surface. A feature of this method is the permissive range of pulverization, which has been found to be practical when sifting the crushed or milled ore through screens varying from 60 to 500 mesh (per inch). In the preferred form, the pulverized ore is ionized by passing the same through a magnetic field which removes or wipes off one ion.

(2–3). The prepared ore is preferably immersed in a protective fluid and simultaneously deposed upon an electrode in a substantially uniform layer submerged at a substantially uniform depth. In practice, water is used as the protective fluid and the supporting electrode is the bottom of a vessel that contains the water in which the layer of ore is bathed by immersion therein. Alternatively, the layer of ore is engageably deposed between the flat faces of opposed electrodes, and is thereby protectively embraced for the conduction of electrical current therethrough. Broadly, this method embodies the subjection of a layer of ore to the reducing capabilities of electrical energy discharged therethrough with or without an enveloping environment. However, it is known that a protective environment is conducive to a high yield, and to this end an enveloping atmosphere of inert gas, for example, and preferably a bath of liquid such as water is employed for this purpose. Therefore, this method involves the charging of prepared ore into an environment conductive to its reduction by means of electrical discharges when supporting the same upon an electrode that receives electrical discharges therethrough. In practice, the ore is deposited in a substantially uniform layer 0.002 to 0.015 inch thick dependent upon grain size, and submerged in water. It is to be understood that the layer thickness and submerged depth will vary with different ores as circumstances require.

4. In accordance with this method electrical energy is dishcarged at random through the aforementioned layer of ore from a multiplicity of discharge points by an electrode superimposed over the layer of ore and opposed to the supporting electrode. In practice, the supporting electrode is substantially horizontal, and the superimposed electrode is in parallel opposition to the supporting electrode. In one form of the process, the two electrodes contactively embrace the grains of ore so that electrical energy is conducted through said grains; the grains of ore providing the resistance which results in a heating effect. In another form the two electrodes are held in spaced opposition and a electrical potential applied so that electrical energy is "spiked" through said grains of ore in the form of arcs moving at random from path to path of least resistance which results in a heating effect, all as conditions change with the melting of said ore into nuggets.

The voltage and amperage and frequency of electrical discharge from the spaced points of discharge will vary as to the requirements of the ore being reduced. Also, the time of subjection is accounted for as it is related to the spacing of the discharge points. In the case of batch processing, the ore is charged onto the supporting electrode, the multiplicity of discharge points charged with electrical potential and discharged to the supporting electrode at random until substantially complete fusion of the metallic values is attained. In the case of continuous processing, the ore is conveyed over the supporting electrode and beneath a multiplicity of opposed electrodes at a rate not to reduce the substantially complete fusion of the metallic values. It will be apparent that the efficiency and/or substantially complete reduction of the metallic values depends upon the thorough penetration of all of the ore by electrical discharges sufficient to fuse substantially all metalic values therein.

This method has been successfully carried out by discharging electrical energy through granular ore in contact with the two electrodes, as well as through a layer of ore spaced beneath the superimposed electrode. In the latter form, the superimposed electrode is spaced in contiguous proximity (0.002 inch) to the granular ore to as much as 0.5 inch from the supporting electrode, and the multiplicity of discharge points of the superimposed electrode ore electrodes are spaced 0.125 to 0.500 inch apart. The electrical potentials employed range, for example, from 1 volt to 10,000 volts at 1/10 to 100 amps, and the frequencies employed range from 750 to 20,000 cycles per second. It is to be understood that the discharge cycles can be programmed for a perdetermined distribution from the said multiplicity of superimposed electrode points.

5. This method contemplates a continuous process in its preferred form, and to this end the ore is conveyed upon or over the supporting electrode so as to pass beneath the said superimposed electrode or multiplicity of electrode points. As is pointed out above, the rate of travel is determined by the exposure required in each instance, for the ultimate purpose of substantially complete subjection of all ore to the penetration of electrical energy discharges therethrough.

6. The ore is thus far subjected to the discharge of electrical energy therethrough is then reduced so as to contain solidified nuggets/globes of the metallic values that have melted and then solidified, all within the layer of ore as deposited upon the supporting electrode and immersed in the protecting fluid. This method is then completed by discharging the layer of metal laden ore from the bath of protective fluid, for subsequent separation of the solidified and stable metal values therefrom. The subsequent separation can be by the various known chemical and/or mechanical methods, the said metalic values being visible to the naked eye or by magnification.

Referring now the apparatus shown in the drawings, this invention involves generally, an ore supporting electrode A, ore supply means B for depositing a layer of ore upon said electrode A, at least one and preferably a plurality of superimposed electrodes C in spaced relation over the electrode A and over a layer of ore supported thereon, vessel means D enveloping or maintaining a level of fluid over the electrode A, and electrical power means E applying electrical potential between the electrodes to discharge energy from one electrode through the layer of ore and to the other supporting electrode.

The apparatus of FIG. 1 is a continuous process apparatus in which the supporting electrode A is a conveyor of circular form, wherein the ore feed tube 13 is at the center and the discharge at the periphery. The electrode A-conveyor is a horizontal disc journaled by bearings 10 to rotate on a vertical axis. The top 12 is planar and of approximately 48 inches diameter with an upstanding rim 11 in the form of a dam (see FIG. 10). A circumferential series of weep holes 14 open outwardly and downwardly from the top 12 and through the wall of the rim-dam 11. A motor drive revolves the electrode A-conveyor at a relatively slow rate of speed, as for example within a range of 2 to 10 RPM so as to have a mild centrifugal action. The vessel means D is comprised of an upstanding surrounding wall 15 spaced from the perimeter margin of the electrode conveyor A. The layer of ore deposited upon the top 12 is free to pass radially through the weep holes 14 at a rate controlled thereby for discharge into an underlying perimeter basin 17 having a downspout 19. The balance of inlet through feed take 13 to discharge from weep hole 14 determines the level of fluid that protectively covers the ore; the said fluid level being maintained by a valve 21 in a water supply line 21' that charges the vessel means D through the feed tube 13.

The supply means B deposits prepared pulverized ore continuously into the feed tube 13, as by means of a hopper and conveyor 35 as is shown; the prepared ore being deposited at the center of the electrode A-conveyor so as to be acted upon by gravity and lateral displacement as well as by centrifugal action to be moved radially outward. Included in the supply means B is ionizing means 23 in the form of an electrically energized coil that establishes a magnetic field through which the ore is charged into the feed tube 13, thereby removing one ion from the pulverized ore.

In accordance with this invention, the at least one superimposed electrode C is placed so as to act upon the layer of ore progressing radially outward upon the electrode top 12. In practice there is a plurality of electrodes C spaced circularly about the center axis of the apparatus, preferably several concentric circles thereof as shown; and to the end that a substantial portion of the area overlying top 12 is covered by electrodes C.

Figure 3:
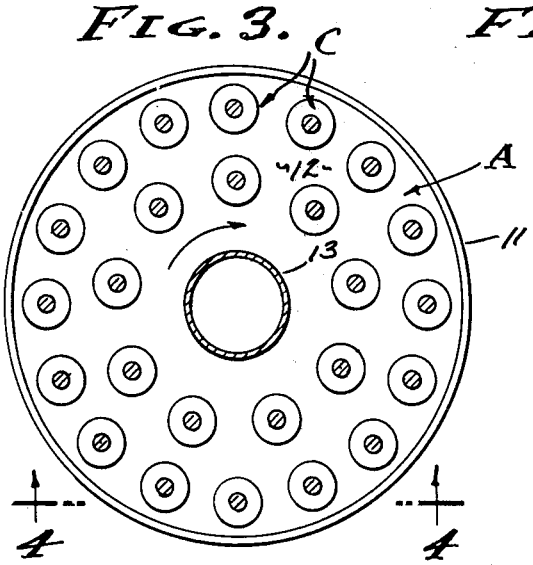
FIG. 3 is a plan section taken as indicated by line 3—3 on FIG. 2.
Figure 4:
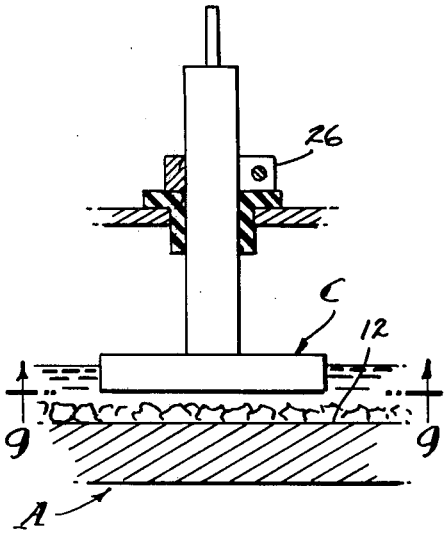
FIG. 4 is an enlarged fragmentary section taken as indicated by line 4—4 on FIG. 3.
Figure 9:
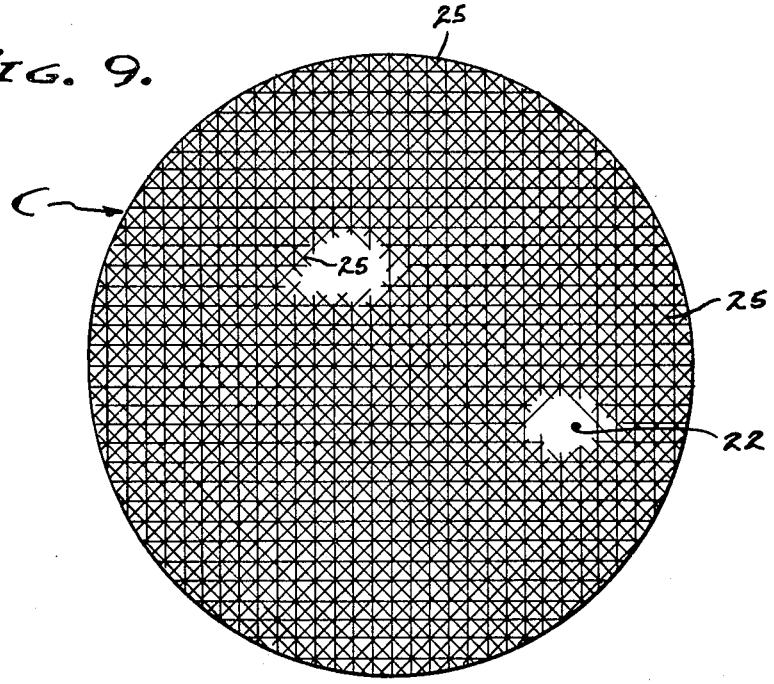
FIG. 9 is an enlarged detailed view taken as indicated by line 9—9 on FIG. 4.
Figure 10:
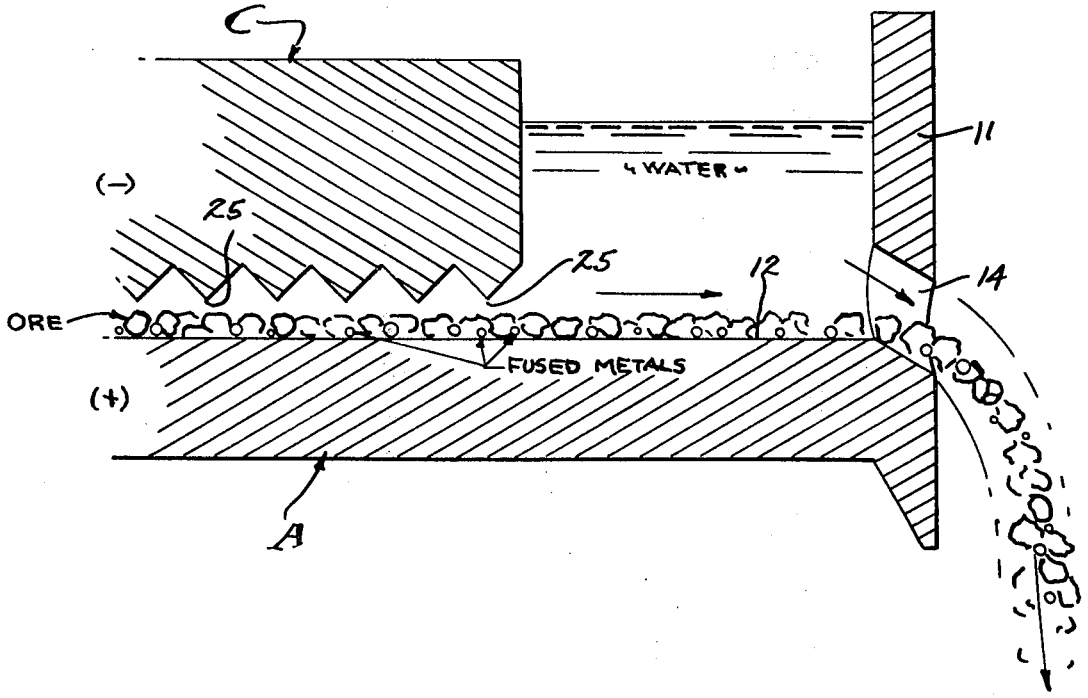
FIG. 10 is an enlarged detailed fragmentary view of a portion of the structure shown in FIG. 2.

Referring to the upper electrode embodiment of FIGS. 3, 4 and 9, each electrode C is a plate-shaped element of high conductivity such as aluminum having a bottom face 22 disposed parallel to and spaced from the top 12 of electrode A. A feature of electrode C is the multi-peaked configuration of the bottom face 22 thereof, there being a vertically adjustable stop collar 26 to prevent the electrode C from touching and shorting out against the electrode A. A heater 23 carries the plurality of electrodes C upon insulators 24 for electrical isolation from the remaining structure. As is best illustrated in FIG. 10 of the drawings, the bottom 22 is serrated to have multiple points 25 disposed at a common height or plane. In practice, double serrations of equilateral tooth form are established at right angles so as to intersect uniformly in the formation of a multitude of pyramidal peaks each having four sides meeting at a point 25. Consequently, all ore passes in a layer beneath the electrode C to receive the multiplicity of electrical arcs spiked at random therethrough by conduction through the ever changing paths of least resistance substantially the same as above described.

Figure 5:
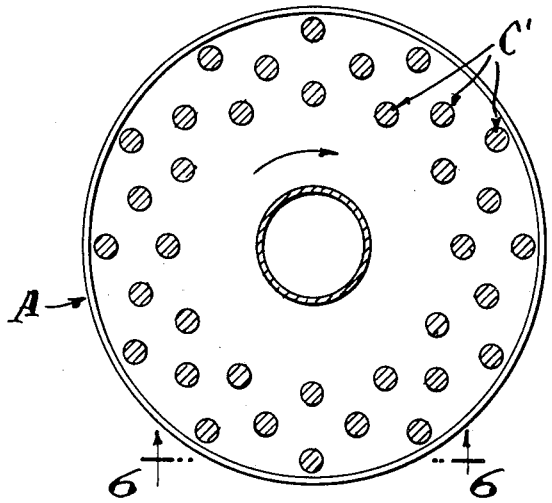
FIG. 5 is a view similar to FIG. 3 showing a modified form of electrodes.
Figure 6:
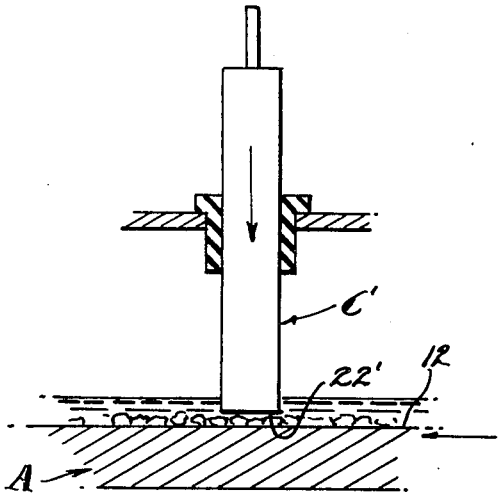
FIG. 6 is an enlarged fragmentary section taken as indicated by line 6—6 on FIG. 5.

Referring now to the upper electrode embodiment of FIGS. 5 and 6, each electrode C′ presents a flat face 22 opposed and parallel to the top 12 of electrode A, and in the form of apparatus now under consideration this face 22′ rests and/or rides upon the layer of ore so as to have contact with the grains thereof. The electrode C′ is preferably a carbon rod with a normal face 22′, gravity acting to depress the same into supporting engagement with and upon the highest standing or largest grain of ore. Consequently, there will always be one or more grains of ore in contact between the two electrodes. The header 23 carries the plurality of electrodes C′, upon insulators 24 for electrical isolation from the remaining structure and so that each is free to fall into contacting engagement with the ore, generally as indicated.

The electrodes C and C′ have been made of carbon-graphite, copper-alloys, aluminum, steel (stainless), tungsten carbide and other such materials which are conducive to the reduction of the ore involved.

Figure 2:
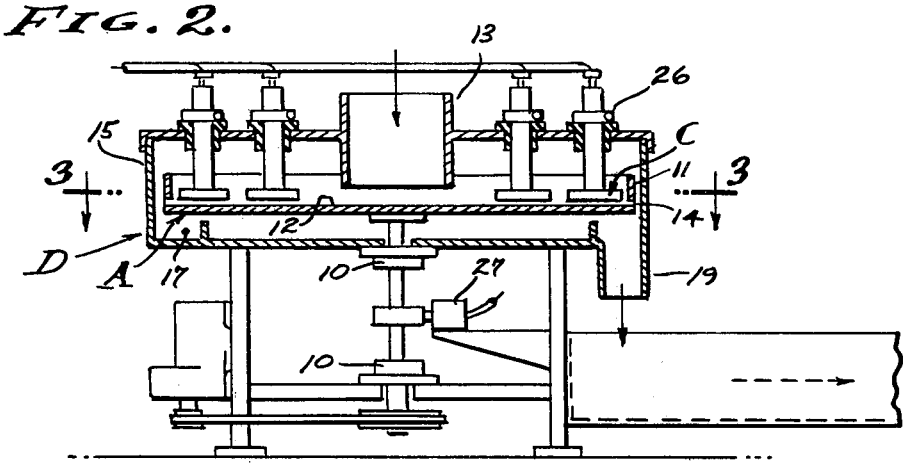
FIG. 2 is an enlarged vertical sectional view of a portion of the apparatus shown in FIG. 1.
Figure 7:
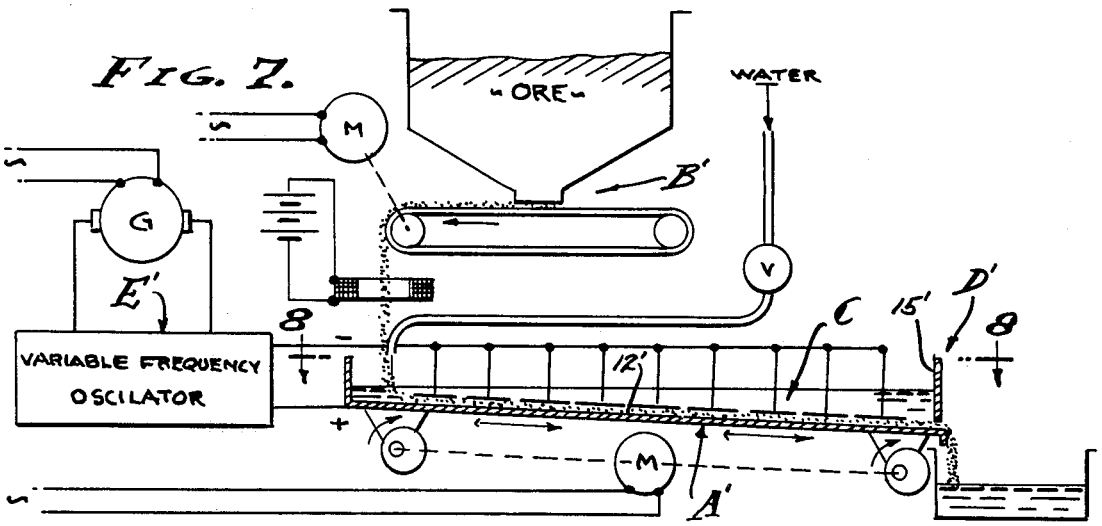
FIG. 7 is a schematic view of the process and second embodiment of apparatus.

The electrical power means E provides a programmed current of controlled A.C. or D.C. potentials as may be required. As shown in FIG. 1 and 7, the anode (+) is the supporting electrode A grounded by brushes 27 in FIG. 2, and the cathode (−) is the at least one contacting electrode C or C′. However, it is to be understood that the output of means E can be a controlled alternating current. Electrical power is obtained from a suitable source such as a generator G, and programmed by a chopper or variable frequency control means 28 with + and − output lines 29 and 30 leading to the anode and cathode respectively. A pulsating D.C. current is supplied by the means 28, for example a capacitor discharge means, characterized by a complete cut-off of current between the cycles at a frequency varying from 750 to 20,000 cycles per second. Consequently, electrical energy discharges intermittently through the ore conducting the same between the electrodes, and the resistance in these ever changing paths produces high temperature in the conductive grains whereby the metal values melt and draw together into a placid or liquid state which then cools to the solid state with cessation of the electrical energy discharges therethrough. In carrying out this invention, the microscopic metallic values diminish in size as they are converted to solid state metal form, all to the end that there is an ever changing conditioning whereby new paths of least resistance are constantly reestablished.

From the foregoing it will be seen that the entire area of ore is eventually subjected to the conduction of electrical energy therethrough. The temperature produced by the resistance of conductivity is determined by the power applied, and the point of application is ever changing at random from the plurality of electrode faces 22–22′ and through paths at lest resistance as conditions inherently change. The resistive heat necessary for the reduction of various representative metals is easily obtained as follows:

| | |
|---|---|
| Lead | 450° F. |
| Silver | 1761° F. |
| Gold | 1981° F. |
| Platinum | 3190° F. |
| Iridium | 4260° F. |

Figure 8:
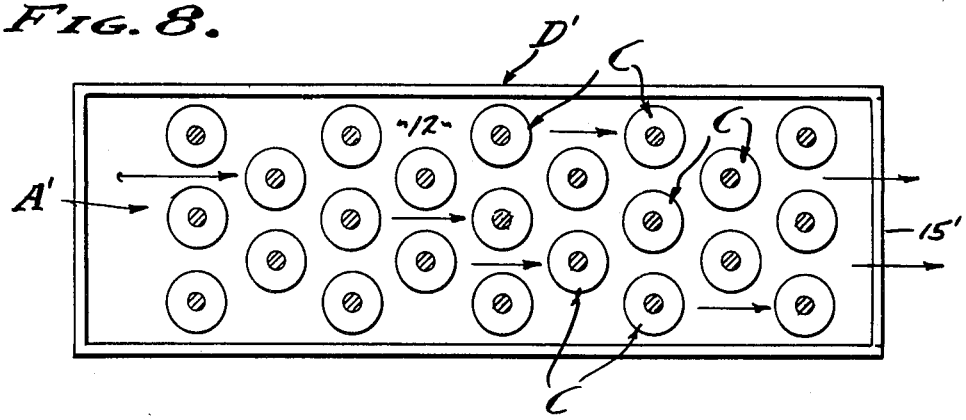
FIG. 8 is a plan section taken as indicated by line 8 on FIG. 7.

Referring now to the apparatus of FIGS. 7 and 8, this is a continuous process apparatus in which the supporting electrode A′ is a conveyor of elongated form, and wherein the ore feed is at one end and the discharge at the other end thereof. This form of apparatus has the essential elements as shown described with reference to the form of FIG. 1, and includes the ore supply means B′, the at least one electrode C, the vessel means D′ and the electrical power means E′. This form of apparatus differs from the former in its mode of conveying the ore rectilinearly from the feed end to the discharge end of the supporting electrode, and to this end the supporting electrode A′ and vessel means D′ are combined into a single trough-shaped unit in which the bath of protective fluid maintained by a wier 15′ that overlies the margin of the electrode A′ at the discharge end of the trough. The trough bottom is the electrode A′, which is declined substantially as shown. The at least one electrode C and preferably a series thereof are positioned in the trough to oppose the top 12′ of the supporting electrode, the faces 22 of electrodes being substantially coextensive with the width of the trough and extending from side to side of the trough as shown.

The conveyor means in this second form is preferably a vibrator means that imposes rectilinear impetus to move the layer of ore toward the discharge end of the electrode A′-trough where it is free to pass beneath the lip of the wier 15′ and into an underlying basin or the like for recovery and subsequent separation of the matallic fines. The preparation of ore and application of electrical power to the electrodes formed with a multiplicity of discharge points remains the same as hereinabove described with reference to the first form of the apparatus.

From the foregoing, it will be seen that the programmed current passes through the layer of ore in a multiude of high temperature paths of least resistance that migrate over the faces 22–22′ of the superimposed electrode C–C′. The electrodes C and C′ as they are hereinabove described are applicable interchangeably to the electrode-conveyor apparatus of either FIG. 1 of FIG. 7. The conduction of each electrical discharge destroys the path of resistance which it followed, and thereby changes the resistance condition so that a new path of resistance is followed from a different discharge point during the next cycle of current discharge, and so on. As a consequency, there is an ever changing pattern of programmed energy application which eventually affects the entire area. By these means, the process and apparatus herein disclosed recovers 90–100% of the metallic values to be found in the ore processed thereby.

This method and apparatus has far reaching affect, as for example in the extraction of precious metals from quartz, black sand and the like metal bearing ores; where the microscopic metallic values have been considered to be locked up and unreduceable on any economical basis. However, by conducting and/or spiking these microscopic metallic values with intermittent charges of electrical energy the minute metal constitutents become placid and are drawn together forming globules. As this smelting occurs, the silica or quartz becomes softened so a to permit the metal constituents to combine; within and/or outside the ore particle confines. When made placid by heat within the ore particle confines, gasification occurs and pressure is generated which tends to burst out the side particle at the weakest softened area thereof. Since the metal is present as the nucleous of the phenomenon the placid globule thereof bursts forth partially or completely, and it is at least exposed to the cooling atmosphere or surrounding fluid which solidifies both the metal and silica-quartz, forming a round ball of both materials or elements.

Thus, the operation of the various forms of apparatus employed to conduct the process, unlocks metallic particles from ore and recovers the same as new virgin metal, making it possible to recover metals which have heretofore been lost in the tailing piles and smelter slag piles. Reduction to practice of this apparatus and involved method as herein discribed has shown beyond doubt that recover of precious metals is commerically feasible therewith, from complex ores where other known recovery methods have failed.

Having described only typical preferred forms and applications of my invention, I do not wish to be limited or restricted to the specific details herein set forth, but wish to reserve to myself any modifications or variations that may appear to those skilled in the art:

I claim:

1. Apparatus for reducing metallic values from granular ore, and including; an upwardly disposed planar electrode for the support of a layer of said granular ore, at least one electrode member with a face opposed to the first mentioned planar electrode and having a multiplicity of electrode points spaced uniformly from the first mentioned electrode to contact the granules of ore, and electrical power means applying potential to the electrodes for discharge of energy through the granules of ore to heat and fuse the said metallic values into the melted state which subsequently solidifies into stable metal form smaller than the ore granules to thereby shift the resistive conductivity from electrode point to electrode point, whereby random discharge of electrical energy is coextensive of said layer of ore with commensurate distribution of subjection of the same to fusion.

2. The apparatus for reducing the metallic values from ore as set forth in claim 1, wherein the ore is delivered to the first mentioned electrode via ionizing means comprised of an encircling winding through which the ore passes for removal of one ion therefrom.

3. The apparatus for reducing the metallic values from ore as set forth in claim 1, wherein the multiplicity of electrode points are pyramidal peaks formed on the face of said at least one electrode member opposed to the first mentioned planar electrode to spike arcs through the grains of ore for random resistive conductivity therethrough.

4. The apparatus for reducing the metallic values from ore as set forth in claim 1, wherein vessel means confines a protective environment to the ore subjected to energy discharged between said electrodes.

5. The apparatus for reducing the metallic values from ore as set forth in claim 1, wherein vessel means contains a bath of protective liquid over the ore subjected to energy discharged between said electrodes.

6. The apparatus for reducing the metallic values from ore as set forth in claim 1, wherein the first mentioned planar electrode is a conveyor means transporting the granular ore beneath the said opposed multiplicity of electrode points.

7. The apparatus for reducing the metallic values from ore as set forth in claim 1, wherein the first mentioned planar electrode is a vibratory conveyor means transporting the granular ore beneath the said opposed multiplicity of electrode points.

8. The apparatus for reducing the metallic values from ore as set forth in claim 1, wherein the first mentioned planar electrode is a moving table conveyor means transporting the granular ore beneath the said opposed multiplicity of electrode points.

9. Apparatus for reducing metallic values from granular ore, and including; a horizontal upwardly faced planar electrode disc disposed on a vertical axis of rotation, drive means rotating the planar electrode for centrifugal force applied to a layer of granular ore supplied to the center thereof, a plurality of electrodes spaced circumferentially and opposed to the peripheral margin of the planar electrode, said plurality of electrodes being carried by insulating means and held out of touching engagement with the first mentioned planar electrode, and electrical power means applying potential to the electrodes for discharge of energy through the granules of ore to heat and fuse the said metallic values into the melted state which subsequently solidifies into stable metal from smaller than the ore granules to thereby shift the resistive conductivity between the said plurality of electrodes, whereby random discharge of electrical energy is coextensive of said layer of ore with commensurate distribution of subjection of the same to fusion.

10. The apparatus for reducing metallic values from ore as set forth in claim 9, wherein each of the said plurality of electrodes is a flat faced member free to rise and fall into riding engagement upon the grains of ore.

11. The apparatus for reducing metallic values from ore as set forth in claim 9, wherein each of the said plurality of electrodes is a flat faced member with a multiplicity of electrode points formed therein to spike arcs through the grains of ore for random resistive conductivity therethrough.

12. The apparatus for reducing metallic values from ore as set forth in claim 9, wherein each of the said plurality of electrodes is a flat faced member with a multiplicity of pyramidal electrode points formed therein to spike arcs through the grains of ore for random resistive conductivity therethrough.

13. The apparatus for reducing metallic values from ore as set forth in claim 9, wherein the upwardly faced planar electrode disc has a peripheral dam to confine a body of liquid over the ore, there being discharge means to deliver ore from the dam.

14. The apparatus for reducing metallic values from ore as set forth in claim 9, wherein the upwardly faced planar electrode disc has a peripheral dam to confine a body of liquid over the ore, there being discharge ports through the dam to deliver ore from the dam.

15. Apparatus for reducing metallic values from granular ore and including; a horizontal trough with an upwardly faced planar bottom-electrode, conveyor means transporting a layer of ore longitudingly of the trough, a plurality of electrodes spaced longitudingly of the trough and opposed to the bottom-electrode, said plurality of electrodes being carried by insulating means and held out of touching engagement with the first mentioned planar electrode, and electrical power means applying potential to the electrodes for discharge of energy through the granules of ore to heat and fuse the said metallic values into the melted state which subsequently solidifies into stable metal from smaller than the ore granules to thereby shift the resistive conductivity between the said plurality of electrodes, whereby random discharge of electrical energy is coextensive of said layer of ore with commensurate distribution of subjection of the same to fusion.

16. The apparatus for reducing metallic values from ore as set forth in claim 15, wherein each of the said plurality of electrodes is a flat faced member free to rise and fall into riding engagement upon the grains of ore.

17. The apparatus for reducing metallic values from ore as set forth in claim 15, wherein each of the said plurality of electrodes is a flat faced member with a multiplicity of electrode points formed therein to spike arcs through the grains of ore for random reisistive conductivity therethrough.

18. The apparatus for reducing metallic values from ore as set forth in claim 15, wherein each of the said plurality of electrodes is a flat faced member with a multiplicity of pyramidal electrode points formed therein to spike arcs through the grains of ore for random resistive conductivity therethrough.

19. The apparatus for reducing metallic values from ore as set forth in claim 15, wherein the upwardly faced planar electrode disc has a peripheral dam to confine a body of liquid over the ore, there being discharge means to deliver or from the dam.

20. The apparatus for reducing metallic values form ore as set forth in claim 15, wherein the upwardly faced planar electrode disc has a peripheral dam to confining a body of liquid over the ore, there being discharge ports through the dam to deliver ore from the dam.

* * * * *